US010895400B2

(12) United States Patent
Yu et al.

(10) Patent No.: US 10,895,400 B2
(45) Date of Patent: Jan. 19, 2021

(54) AIR DEFLECTOR MOVING MECHANISM AND AIR CONDITIONER

(71) Applicant: GREE ELECTRIC APPLIANCES, INC. OF ZHUHAI, Guangdong (CN)

(72) Inventors: Jiebin Yu, Guangdong (CN); Zhihui Liang, Guangdong (CN); Shuangjin Li, Guangdong (CN); Qilong Wang, Guangdong (CN); Zhilin Wang, Guangdong (CN); Dong Pei, Guangdong (CN)

(73) Assignee: GREE ELECTRIC APPLIANCES, INC. OF ZHUHAI, Guangdong (CN)

( * ) Notice: Subject to any disclaimer, the term of this patent is extended or adjusted under 35 U.S.C. 154(b) by 68 days.

(21) Appl. No.: 16/330,258

(22) PCT Filed: Feb. 14, 2017

(86) PCT No.: PCT/CN2017/073450
§ 371 (c)(1),
(2) Date: Mar. 4, 2019

(87) PCT Pub. No.: WO2018/058880
PCT Pub. Date: Apr. 5, 2018

(65) Prior Publication Data

US 2019/0226713 A1 Jul. 25, 2019

(30) Foreign Application Priority Data

Sep. 28, 2016 (CN) ..... 2016 1 0859856

(51) Int. Cl.
*F24F 13/08* (2006.01)
*F24F 7/00* (2006.01)
(Continued)

(52) U.S. Cl.
CPC ..... *F24F 13/1426* (2013.01); *F24F 1/0011* (2013.01); *F24F 13/10* (2013.01); *F24F 13/15* (2013.01); *F24F 2013/1473* (2013.01)

(58) Field of Classification Search
CPC ..... F24F 13/1426; F24F 1/0011; F24F 13/10; F24F 13/15; F24F 2013/1473
(Continued)

(56) References Cited

U.S. PATENT DOCUMENTS 5,857,343 A * 1/1999 Cho ..... F24F 1/0007 62/89
2006/0199504 A1* 9/2006 Moon ..... F24F 1/0011 454/229

FOREIGN PATENT DOCUMENTS

CN 1727800 A 2/2006
CN 101210729 A 7/2008
(Continued)

OTHER PUBLICATIONS

International Search Report for International Application No. PCT/CN2017/073450, dated Jul. 11, 2017, 2 pages.

*Primary Examiner* — Helena Kosanovic
(74) *Attorney, Agent, or Firm* — Armstrong Teasdale LLP

(57) ABSTRACT

Disclosed is an air deflector moving mechanism. The air deflector moving mechanism includes an air deflector (1) and a driving mechanism. The air deflector (1) is in a drive connection with the driving mechanism and moves under a driving action by the driving mechanism. The driving mechanism includes a rotary column (2). A driving groove (3) extending in an axial direction is provided circumferentially on an outer periphery of the rotary column (2). The air deflector (1) is provided with a driving head (4) disposed in the driving groove (3). Also disclosed is an air conditioner including the air deflector moving mechanism.

5 Claims, 3 Drawing Sheets

(51) Int. Cl.

| | |
|---|---|
| ***F24F 13/14*** | (2006.01) |
| ***F24F 1/0011*** | (2019.01) |
| ***F24F 13/15*** | (2006.01) |
| ***F24F 13/10*** | (2006.01) |

(58) Field of Classification Search
USPC ..... 454/358
See application file for complete search history.

(56) References Cited

FOREIGN PATENT DOCUMENTS

| | | | |
|---|---|---|---|
| CN | 101655275 | A | 2/2010 |
| CN | 106369676 | A | 2/2017 |
| CN | 206131169 | U | 4/2017 |
| JP | 2000241012 | A | 9/2000 |
| WO | 2013034114 | A1 | 3/2013 |

* cited by examiner

AIR DEFLECTOR MOVING MECHANISM AND AIR CONDITIONER

CROSS-REFERENCE TO RELATED APPLICATIONS

The present application is the national stage entry of International Patent Application No. PCT/CN2017/073450, filed on Feb. 14, 2017, which claims the benefit of priority to Chinese Patent Application No. 201610859856.3, filed on Sep. 28, 2016, the contents of which are hereby incorporated by reference in their entirety.

TECHNICAL FIELD

The present disclosure relates to the technical field of air conditioning, and more particularly to an air deflector moving mechanism and an air conditioner.

BACKGROUND

An air deflector is a component that guides airflow in an air conditioner. In the conventional art, a rotary shaft is disposed at one end of the air deflector. When the air conditioner is required to be in different modes such as cooling or heating, a driving source drives the air deflector to move or rotate, so as to make airflow blown from the air conditioner flow in a preset direction.

The existing air deflector is driven by a gear mechanism or a link mechanism, the air deflector is disposed on an air conditioner housing, the gear mechanism or the link mechanism is connected between the air deflector and the air conditioner housing, and a driving mechanism drives the gear mechanism or the link mechanism to move and drives the air deflector to move, so as to guide air outlet of the air conditioner. However, due to the complicated structure of the gear mechanism or the link mechanism, the stability during the movement process is poor. Therefore, in the process of driving the air deflector, the air deflector is easily shaken, and an abnormal noise is easily generated. The air outlet performance of the air conditioner and the user experience are affected.

SUMMARY

In view of this, Some embodiments of the present disclosure provide an air deflector moving mechanism and an air conditioner, capable of ensuring the stability of movement in the driving process of an air deflector and improving the user experience.

In order to achieve the above objective, according to an embodiment of the present disclosure, an air deflector moving mechanism is provided. The air deflector moving mechanism includes an air deflector and a driving mechanism. The air deflector is in a drive connection with the driving mechanism and moves under a driving action by the driving mechanism. The driving mechanism includes a rotary column. A driving groove extending in an axial direction is provided circumferentially on an outer periphery of the rotary column. The air deflector is provided with a driving head disposed in the driving groove.

In an exemplary embodiment, a projection of the driving groove on a longitudinal mid-plane of the rotary column passing through a rotary shaft is elliptical, U-shaped, V-shaped, inverted V-shaped, or n-shaped.

In an exemplary embodiment, the driving head is cylindrical, and a cross section of the driving groove is rectangular or trapezoidal.

In an exemplary embodiment, the driving head is shaped like a ball head, the driving head is embedded in the driving groove, and an opening width of the driving groove is smaller than a diameter of the ball head.

In an exemplary embodiment, the air deflector moving mechanism further includes a guide rail, wherein the air deflector is in slide fit with the guide rail, and the driving mechanism drives the air deflector to slide along the guide rail.

In an exemplary embodiment, a connecting rod is disposed on the air deflector, and the driving head is disposed on the connecting rod.

In an exemplary embodiment, the rotary column is provided with two driving grooves, and the connecting rod is provided with two driving heads corresponding to the two driving grooves.

According to another embodiment of the present disclosure, an air conditioner is provided. The air conditioner includes an air deflector moving mechanism. The air deflector moving mechanism is the above air deflector moving mechanism.

In an exemplary embodiment, the air conditioner further includes a bottom shell, wherein the bottom shell is formed with an air duct, an air deflector is rotatably disposed at an opening of the air duct, a driving head is disposed at one side of the air deflector, and a driving mechanism drives the air deflector to rotate relative to the air duct through the driving head.

In an exemplary embodiment, there are two air deflectors disposed at the opening of the air duct side by side, there are two driving grooves, and the air deflectors are in one-to-one corresponding drive connection with the driving grooves.

The air deflector moving mechanism according to the present disclosure includes an air deflector and a driving mechanism. The air deflector is in a drive connection with the driving mechanism and moves under a driving action by the driving mechanism. The driving mechanism includes a rotary column. A driving groove extending in an axial direction is provided circumferentially on an outer periphery of the rotary column. The air deflector is provided with a driving head disposed in the driving groove. The air deflector of the air deflector moving mechanism cooperates with the air deflector through the driving groove on the rotary column to drive the air deflector, which simplifies the structure of the air deflector moving mechanism. Moreover, the cooperation structure of the air deflector and the driving groove of the rotary column is simple and stable, the structure of the air deflector can be ensured without jitter during the adjustment process and after the adjustment, the occurrence of noise during the use of the air deflector can be reduced, and the user experience is improved. Moreover, since the rotary column has a simple structure and directly cooperates with the air deflector, the structure of the air deflector moving mechanism is compact, which is advantageous for reducing space occupation.

The above description is only an overview of the technical solutions of the present disclosure, and the technical means of the present disclosure can be more clearly understood and can be implemented in accordance with the contents of the specification. Hereinafter, the preferred embodiments of the present disclosure will be described in detail with reference to the accompanying drawings.

BRIEF DESCRIPTION OF THE DRAWINGS

The accompanying drawings, which constitute a part of the present disclosure, are used to provide a further understanding of the present disclosure, and the exemplary embodiments of the present disclosure and the description thereof are used to explain the present disclosure, but do not constitute improper limitations to the present disclosure. In the drawings.

Figure 1:
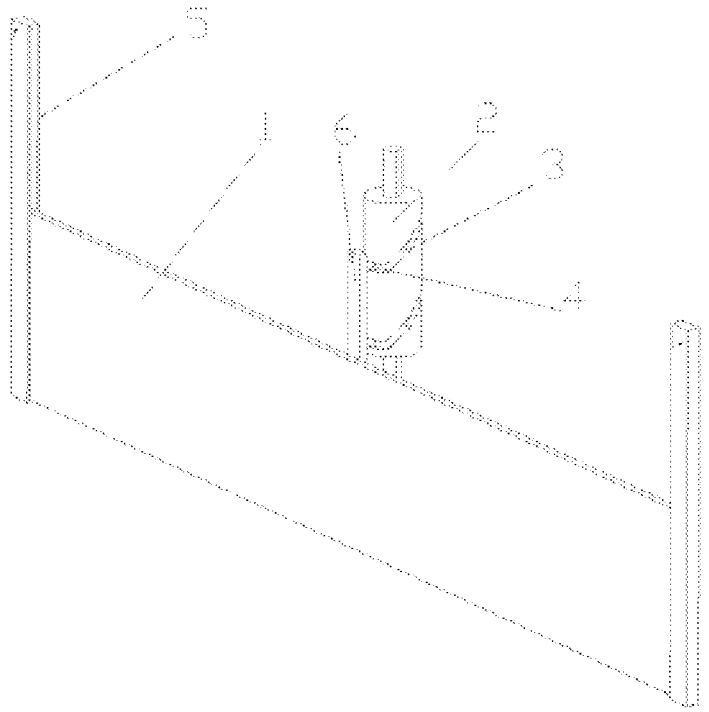
FIG. 1 is a stereostructure diagram of an air deflector moving mechanism according to a first embodiment of the present disclosure.
Figure 2:
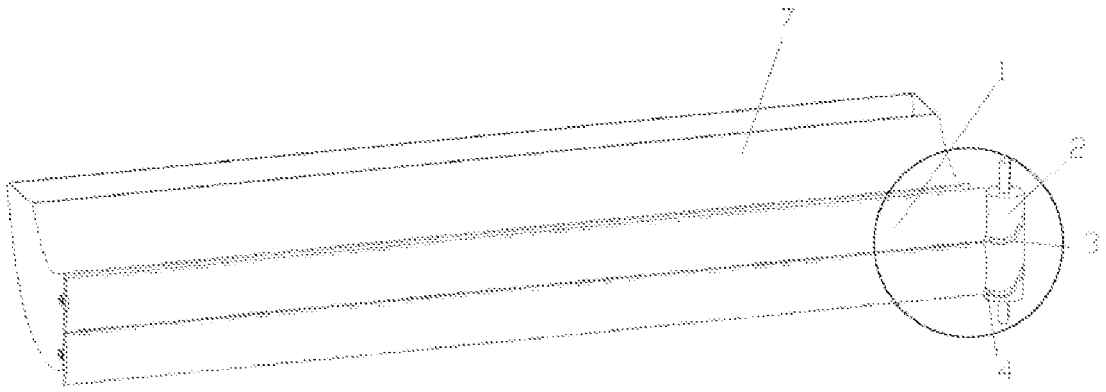
FIG. 2 is a first axonometric drawing of an air deflector moving mechanism according to a second embodiment of the present disclosure.
Figure 3:
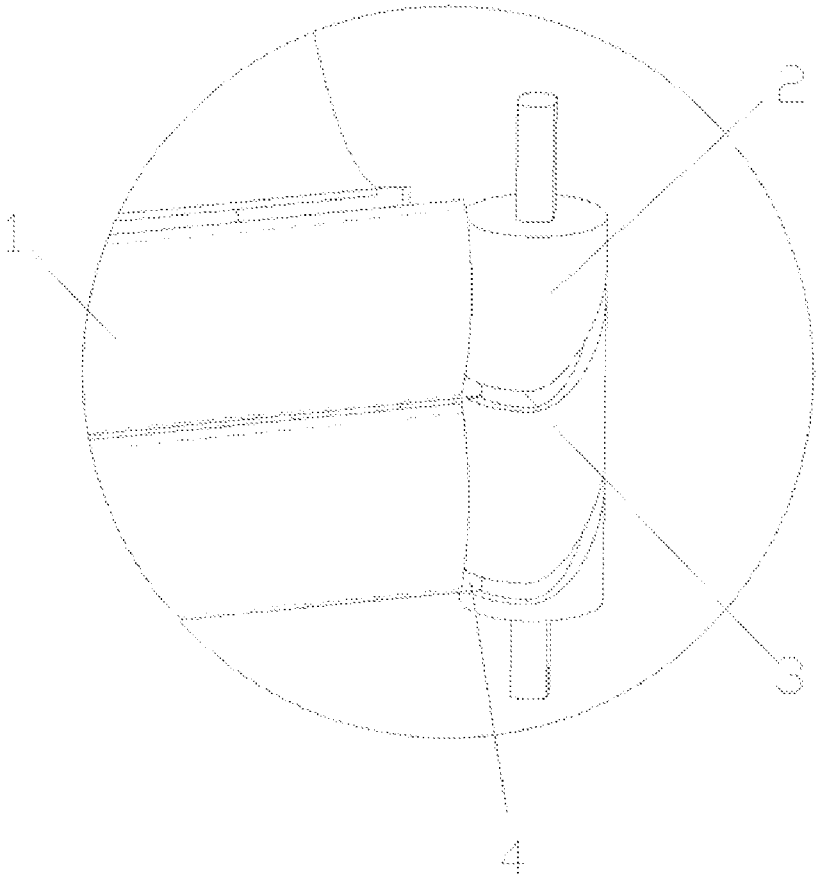
FIG. 3 is an enlarged structure diagram of a circled part Q in FIG. 2.
Figure 4:
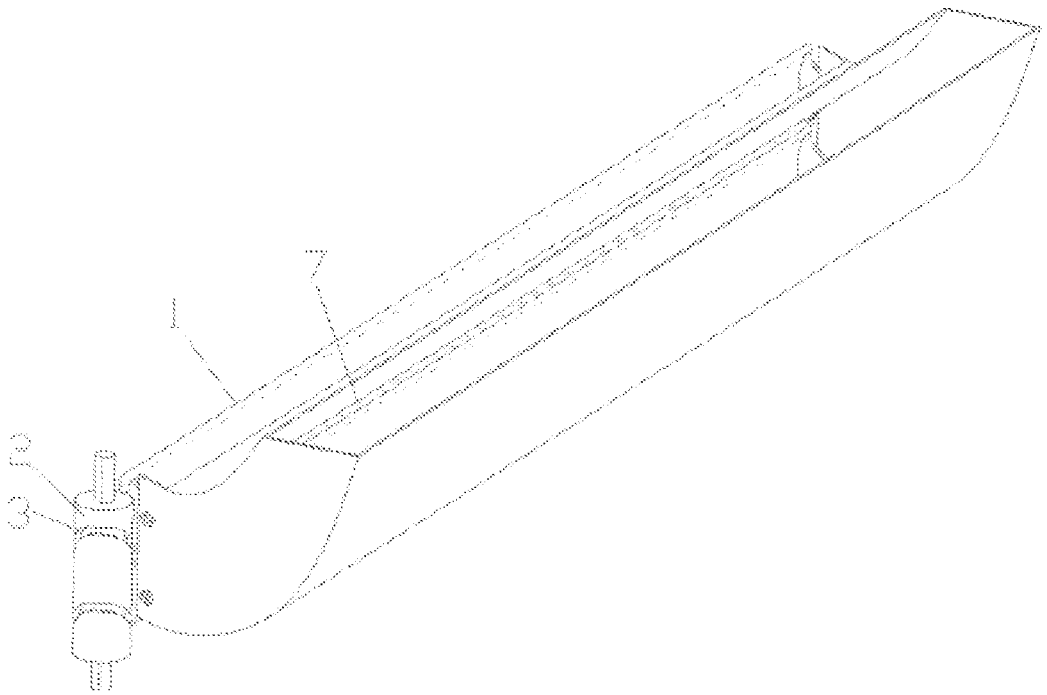
FIG. 4 is a second axonometric drawing of an air deflector moving mechanism according to a second embodiment of the present disclosure.
Figure 5:
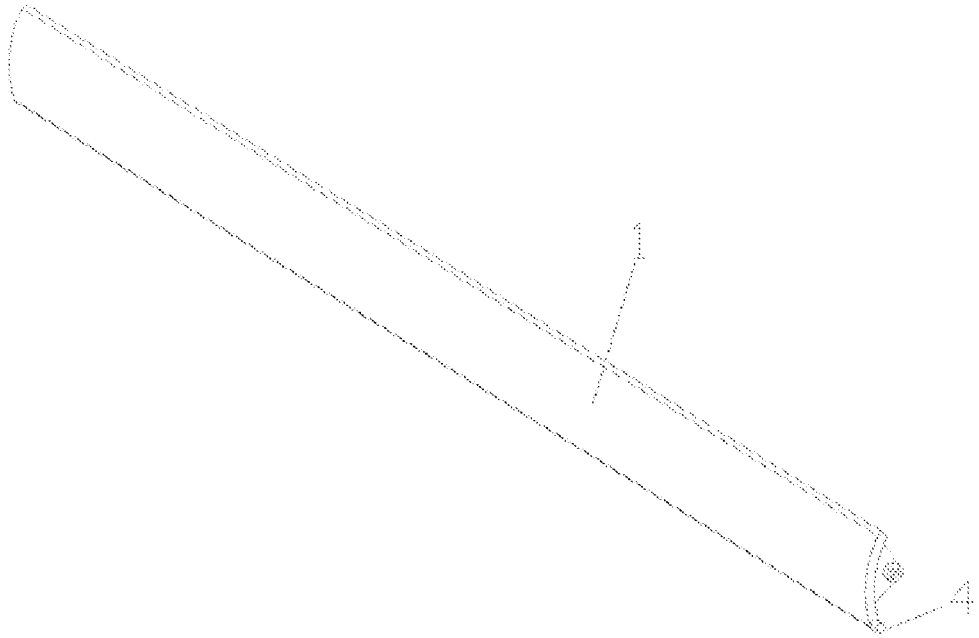
FIG. 5 is a stereostructure diagram of an air deflector of an air deflector moving mechanism according to a second embodiment of the present disclosure.

Drawing reference signs: 1, air deflector; 2, rotary column; 3, driving groove; 4, driving head; 5, guide rail; 6, connecting rod; 7, bottom shell.

DETAILED DESCRIPTION OF THE EMBODIMENTS

In order to make the objectives, technical solutions and advantages of the present disclosure clearer, the technical solutions of the present disclosure will be clearly and completely described hereinbelow with specific embodiments of the present disclosure and the corresponding drawings. It is apparent that the described embodiments are only part of the embodiments of the present disclosure, not all of the embodiments. On the basis of the embodiments of the present disclosure, all other embodiments obtained on the premise of no creative work of those of ordinary skill in the art fall within the scope of protection of the present disclosure.

Referring to FIG. 1 to FIG. 5, according to the embodiments of the present disclosure, an air deflector moving mechanism includes an air deflector 1 and a driving mechanism. The air deflector 1 is in a drive connection with the driving mechanism and moves under a driving action by the driving mechanism. The driving mechanism includes a rotary column 2. A driving groove 3 extending in an axial direction (up-down in FIG. 1) is provided circumferentially on an outer periphery of the rotary column 2, so as to form a cam driving mechanism. The air deflector 1 is provided with a driving head 4 disposed in the driving groove 3.

The air deflector of the air deflector moving mechanism cooperates with the driving head 4 on the air deflector 1 through the driving groove 3 on the rotary column 2 to drive the air deflector 1, which simplifies the structure of the air deflector moving mechanism. Moreover, the cooperation structure of the air deflector 1 and the driving groove 3 of the rotary column 2 is simple and stable, the structure of the air deflector 1 can be ensured without jitter during the adjustment process and after the adjustment, the occurrence of noise during the use of the air deflector 1 can be reduced, and the user experience is improved. Moreover, since the rotary column 4 has a simple structure and directly cooperates with the air deflector 1, the structure of the air deflector moving mechanism is compact, which is advantageous for reducing space occupation.

During the rotation of the rotary column 2, different positions of the driving groove 3 cooperate with the driving head 4 to drive the driving head 4 to move accordingly. With the change of the cooperation position of the driving groove 3 and the driving head 4, the sliding position or the rotating position of the air deflector 1 can be adjusted, thereby realizing the adjustment of the working position of the air deflector 1.

A projection of the driving groove 3 on a longitudinal mid-plane of the rotary column 2 passing through a rotary shaft is elliptical, U-shaped, V-shaped, inverted V-shaped, or n-shaped. The projection of the driving groove 3 on the longitudinal mid-plane of the rotary column 2 may also be other patterns as long as the axial position (up-down position) of the rotary column 2 can be adjusted. When the projection is elliptical, the driving head 4 moves from down to up along the elliptical shape under the driving limitation of the driving groove 3; when the projection is U-shaped, the driving head 4 moves from down to up along the U-shaped driving groove under the driving limitation of the driving groove 3; when the projection is n-shaped, the driving head 4 moves from up to down along the n-shaped driving groove under the driving limitation of the driving groove 3; when the projection is V-shaped, the driving head 4 moves from down to up along the V-shaped driving groove under the driving limitation of the driving groove 3; and when the projection is inverted V-shaped, the driving head 4 moves up to down along the inverted V-shaped driving groove under the driving limitation of the driving groove 3. According to the arranging position and working environment of the air deflector, one of the above projection modes can be selected as needed.

Preferably, in the present embodiment, the driving head 4 is cylindrical, and a cross section of the driving groove 3 is rectangular or trapezoidal. The cross section is a section along the width direction of the driving groove 3.

In embodiments not shown in the figure, the driving head 4 may be shaped like a ball head, the driving head 4 is embedded in the driving groove 3, and an opening width of the driving groove 3 is smaller than a diameter of the ball head. Since the ball head of the driving head 4 is embedded in the driving groove 3, and the diameter of the ball head is larger than the opening width of the driving groove 3, the driving head 4 can be better held in the driving groove 3, the stable driving effect of the rotary column 2 and the air deflector 1 is ensured, and the structural stability and reliability of the air deflector moving mechanism are improved. Furthermore, the ball head structure also makes the movement of the driving head 4 inside the driving groove 3 smoother, and can reduce the resistance when the rotary column 2 rotates and reduce the energy loss.

Referring to FIG. 1, according to the first embodiment of the present disclosure, the air deflector moving mechanism further includes a guide rail 5, wherein the air deflector 1 is in slide fit with the guide rail 5, for example, both ends of the air deflector 1 are slidably disposed in the guide rail 5, and the driving mechanism drives the air deflector 1 to slide along the guide rail 5. In the present embodiment, the guide rail 5 can guide the up and down sliding of the air deflector 1 and form a limit on the movement of the air deflector 1 in other directions, so that the air deflector 1 can only slide up and down by one degree of freedom to ensure the accuracy of the movement structure of the air deflector 1. During the rotation of the rotary column 2, the point on the driving groove 3 that cooperates with the driving head 4 on the air deflector 1 is constantly changed as the rotary column 2 rotates, so that the air deflector 1 moves with the up and down movement of the driving head 4, and the sliding position of the air deflector 1 can be conveniently adjusted. Since the left and right positions of the air deflector 1 are fixed, the rotation of the rotary column 2 can stably and continuously adjust the up and down positions of the air deflector 1, thereby avoiding the deviation of the movement position of the air deflector 1, and improving the movement control accuracy of the air deflector 1.

Preferably, a connecting rod 6 is disposed on the air deflector 1, and the driving head 4 is disposed on the connecting rod 6. The connecting rod 6 can extend the length of the air deflector 1 and can facilitate the drive connection between the air deflector 1 and the rotary column 2, thereby avoiding the problem that the air deflector 1 interferes with the arranging position of the rotary column 2, simplifying the processing structure of the air deflector 1, and reducing the processing difficulty and the processing cost. When the air deflector 1 is processed, the deflector body and the connecting rod 6 can be separately processed, the driving head 4 is directly processed on the connecting rod 6, and then the connecting rod 6 is fixedly connected to the corresponding position of the air deflector 1 by bolting or the like, so that the structural design of the air deflector 1 is made simpler and more convenient.

Preferably, the rotary column 2 is provided with two driving grooves 3, and the connecting rod 6 is provided with two driving heads 4 corresponding to the two driving grooves 3. According to the principle of forming a line between two points, a driving head can be respectively disposed at the up and down positions of the connecting rod 6 to ensure the movement of the air deflector 1 in the up and down direction, thereby ensuring the accuracy of the movement direction of the air deflector 1. Of course, the number of the driving heads 4 can also be set as needed, and is not limited to one or two. Accordingly, the number of the driving grooves 3 can also be changed accordingly.

In the above embodiment, the vertical arrangement of the rotary column 2 is only one of the embodiments, and the rotary column 2 can also be horizontally disposed or otherwise disposed. At this time, the arrangement of the air deflector 1 is also adjusted accordingly according to the arrangement of the rotary column 2, but as long as the cooperation relationship is the same as the embodiment of the present disclosure, it should be included in the scope of protection of the present disclosure.

The above air deflector moving mechanism may further include a driving motor in drive connection with the rotary column 2.

According to the embodiment of the present disclosure, an air conditioner includes an air deflector moving mechanism. The air deflector moving mechanism is the above air deflector moving mechanism.

Referring to FIG. 2 to FIG. 5, according to the embodiments of the present disclosure, the air conditioner further includes a bottom shell 7, wherein the bottom shell 7 is formed with an air duct, an air deflector 1 is rotatably disposed at an opening of the air duct, a driving head 4 is disposed at one side of the air deflector 1, and a driving mechanism drives the air deflector 1 to rotate relative to the air duct through the driving head 4.

Since the driving head 4 is disposed at one side of the rotation axis of the air deflector 1 and the bottom shell 7, and the air deflector 1 and the bottom shell 7 are rotationally connected, the up and down positions of the driving head 4 can be changed by the rotation of the rotary column 2. The driving head 4 drives the side of the air deflector 1 to rise or fall, the relative rotational position between the air deflector 1 and the bottom shell 7 and the air duct is adjusted, and the rotational position of the air deflector 1 is adjusted to adjust the direction of air outlet at the opening of the air duct, so that the adjustment is more convenient. Because of the contact fit between the driving head 4 and the driving groove 3, the intermediate structure is less, thereby reducing the connection error, reducing noise due to the installation error and the excessive number of intermediate transmission components, and improving the user experience.

There may be no connection between the air deflector 1 and the bottom shell 7, as long as the air deflector 1 can be rotated at the air opening position of the bottom shell 7 to achieve an air guiding effect.

Preferably, there are two air deflectors 1 disposed at the opening of the air duct side by side, there are two driving grooves 3, and the air deflectors 1 are in one-to-one corresponding drive connection with the driving grooves 3. By providing a plurality of driving grooves 3 in an axial direction of the rotary column 2, it is possible to rotationally drive the plurality of air deflectors 1 arranged up and down, so that the air guiding of the air deflector 1 can be more conveniently controlled.

It is to be noted that the embodiments of the present disclosure and the features of the embodiments may be combined with each other without conflict.

The above is only a preferred embodiment of the present disclosure, and is not intended to limit the present disclosure in any way. Any simple amendments, equivalent changes and modifications made to the above embodiments in accordance with the technical spirit of the present disclosure are still within the scope of the technical solutions of the present disclosure.

What is claimed is:

1. An air deflector moving mechanism, comprising an air deflector (1) and a driving mechanism, wherein the air deflector (1) is in a drive connection with the driving mechanism and moves under a driving action by the driving mechanism, the driving mechanism comprises a rotary column (2), a driving groove (3) extending in an axial direction is provided circumferentially on an outer periphery of the rotary column (2), and the air deflector (1) is provided with a driving head (4) disposed in the driving groove (3), wherein the driving head (4) is ball-shaped, the driving head (4) is embedded in the driving groove (3), and an opening width of the driving groove (3) is smaller than a diameter of the ball, a connecting rod (6) is disposed on the air deflector (1), and the driving head (4) is disposed on the connecting rod (6), the rotary column (2) is provided with a second driving groove (3), and the connecting rod (6) is provided with a second driving head (4) corresponding to the two driving grooves (3).

2. The air deflector moving mechanism as claimed in claim 1, wherein a projection of the driving groove (3) on a longitudinal mid-plane of the rotary column (2) passing through a rotary shaft is elliptical, U-shaped, V-shaped, inverted V-shaped, or n-shaped.

3. The air deflector moving mechanism as claimed in claim 1, wherein the driving heads (4) are cylindrical, and a cross section of the driving grooves (3) are rectangular or trapezoidal.

4. The air deflector moving mechanism as claimed in claim 1, further comprising a guide rail (5), wherein the air deflector (1) is in slide fit with the guide rail (5), and the driving mechanism drives the air deflector (1) to slide along the guide rail (5).

5. An air conditioner, comprising an air deflector moving mechanism, wherein the air deflector moving mechanism is the air deflector moving mechanism as claimed in claim 1.

* * * * *